US007928821B2

(12) United States Patent
Matsubayashi et al.

(10) Patent No.: US 7,928,821 B2
(45) Date of Patent: Apr. 19, 2011

(54) IGNITION COIL

(75) Inventors: Shuichi Matsubayashi, Tsurugashima (JP); Ikuo Hirayama, Tsurugashima (JP); Masami Kojima, Chiryu (JP); Takashi Tauchi, Nagoya (JP); Takeshi Morimoto, Tajimi (JP); Atsushi Iwami, Kariya (JP)

(73) Assignees: Toyo Denso Kabushiki Kaisha, Tokyo (JP); Denso Corporation, Kariya (JP)

( * ) Notice: Subject to any disclaimer, the term of this patent is extended or adjusted under 35 U.S.C. 154(b) by 369 days.

(21) Appl. No.: 12/150,162

(22) Filed: Apr. 25, 2008

(65) Prior Publication Data

US 2008/0264397 A1 Oct. 30, 2008

(30) Foreign Application Priority Data

Apr. 27, 2007 (JP) ..... 2007-119211
Apr. 27, 2007 (JP) ..... 2007-119217

(51) Int. Cl.
*H01F 27/02* (2006.01)
*H01F 38/12* (2006.01)

(52) U.S. Cl. ..... 336/90; 123/634

(58) Field of Classification Search ..... 336/90; 123/634

See application file for complete search history.

(56) References Cited

U.S. PATENT DOCUMENTS 5,285,761 A * 2/1994 Hancock et al. ..... 123/634
5,349,320 A * 9/1994 Suzuki et al. ..... 336/92
5,448,217 A * 9/1995 Luetzow ..... 336/227

FOREIGN PATENT DOCUMENTS

JP 09-186031 7/1997
JP 11-144986 5/1999

* cited by examiner

*Primary Examiner* — Anh T Mai
*Assistant Examiner* — Ronald W Hinson
(74) *Attorney, Agent, or Firm* — Cohen Pontani Lieberman & Pavane LLP

(57) ABSTRACT

A high-strength ignition coil that can reduce stress produced in a coil case and prevent a casting material from being cracked when the ignition coil is mounted on an engine block. A coil case has a mounting flange on an outer surface thereof. A coil assembly is housed in the coil case. A casting material is filled into a gap between the coil case and the coil assembly and gaps which the coil assembly has. A plurality of first guide ribs are provided on an inner wall surface of the coil case or an outer surface of the coil assembly, for positioning the outer surface of the coil assembly with respect to the inner wall surface of the coil case. A limited area in which there is no first guide rib is provided on the inner wall surface of the coil case which faces the mounting flange, or the outer surface of the coil assembly which faces the mounting flange via the inner wall surface of the coil case.

15 Claims, 12 Drawing Sheets

IGNITION COIL

BACKGROUND OF THE INVENTION

1. Field of the Invention

The present invention relates to an ignition coil, and in particular to an ignition coil of a typical internal combustion engine and an ignition coil directly mounted on a plug hole of an engine.

2. Description of the Related Art

In internal combustion engines such as vehicle engines, an ignition coil and an ignition plug are used as detonators that burn gasoline as fuel.

Examples of publications of prior arts relating to an ignition coil for an internal combustion engine include Japanese Laid-Open Patent Publication (Kokai) No. H09-186031 and Japanese Laid-Open Patent Publication (Kokai) No. H11-144986.

FIG. 12 is a longitudinal sectional view showing an ignition coil disclosed in Japanese Laid-Open Patent Publication (Kokai) No. H09-186031. The ignition coil in FIG. 12 is a so-called plug top coil (hereinafter referred to as a "PTC") and is comprised mainly of a cylindrical coil case 91 having one end thereof opened, a plug cover 92 that is engaged with-an opening in a lower portion of the coil case 91, a low-voltage terminal socket 93 that is mounted on the outside of an upper portion of the coil case 91, a mounting flange 103 that is provided such as to face the low-voltage terminal socket 93, and a coil assembly that is housed in the coil case 91.

The coil assembly is comprised of a primary coil bobbin 95 around which a primary coil 94 is wound, a secondary coil bobbin 97 that is disposed outside and concentrically with the primary coil bobbin 95 and around which a secondary coil 96 is wound, and a bar-shaped core 98 that is inserted into a hollow-body shaft of the secondary coil bobbin 97. A high-voltage terminal mounting portion 99 is formed at a lower end of the secondary coil bobbin 97 of the coil assembly, and an ignition plug 102 is installed so that a distal end thereof is connected to a high-voltage terminal 100 mounted on the mounting portion 99 via a contact 101.

The above constructional members are positioned singly or as an assembly of a plurality of members and then formed as an integral unit by filling thermosetting insulating resin such as epoxy rein into gaps between the constructional members.

FIG. 13 is a horizontal sectional view showing the mounting flange 103 appearing in FIG. 12 and its vicinity.

As shown in FIG. 13, the mounting flange 103 is, for example, integrally molded on an outer peripheral wall of the coil case 91 and has upper and lower two ribs (not shown) in the longitudinal direction of the coil case 91. The upper and lower two ribs ensure the strength of the mounting flange 103 and prevent the mounting flange 103 from becoming deformed during mounting. A top portion of the mounting flange 103 and its vicinity are constructed as a bolt seating 105, in which a bolt hole 106 is formed parallel to the coil case 91.

An igniter 107 is disposed inside the coil case 91 and supported by guide ribs 108 provided on an inner peripheral surface of the coil case 91 which faces the mounting flange 103. The guide ribs 108 guide not only a control unit having the igniter 107 but also an outer peripheral surface of the coil assembly having the primary coil 95 and the secondary coil 96 and positions them in the coil case 91.

In general, a core as a constructional member of an ignition coil is disposed such as to be inserted into a central space of a coil bobbin around which a primary coil or a secondary coil is wound, and in most cases, the core is insertion-molded using mold resin so as to improve corrosion resistance.

FIG. 14 is a longitudinal sectional view showing the relationship between a secondary spool and a cushioning member that is disposed around a central core in an ignition coil disclosed in Japanese Laid-Open Patent Publication (Kokai) No. H11-144986.

As shown in FIG. 14, projections as positioning means 63 for positioning the cushioning member 62 concentrically with and apart from the secondary spool 61 that supports a pair of coils are provided on an inner surface of the secondary spool 61 on the high-voltage side. Also, projections as low-voltage side positioning means 64 for positioning the secondary spool 61 concentrically with and apart from the cushioning member 62 are provided on an outer surface of the cushioning member 62 on the low-voltage side (an outer surface of an upper portion of the cushioning member 62 as viewed in the drawing).

However, the ignition coil disclosed in Japanese Laid-Open Patent Publication (Kokai) No. H09-186031 has the problem that, because the guide ribs 108 for supporting the constructional members are provided on the inner wall surface of the coil case 91 which faces the mounting flange 103, when the ignition coil is fixed, that is, when the ignition coil is fixed at a predetermined location of an engine block by inserting a flange bolt into a bolt hole 106 of the bolt seating 105, the mounting flange 103 and its vicinity become slightly deformed due to fastening stress of the flange bolt, and the deformation reaches the guide ribs 108, and as a result, stress is produced in the hardened insulating resin (casting material) as well, causing the insulating resin to be cracked.

The above problem tends to arise in an ignition coil of the type that a mounting flange itself cannot be made large in size and an ignition coil of the type that, for example, a triangular rib for reinforcement cannot be provided on a mounting flange due to narrowing of a space around an ignition coil mounting portion. In particular, the above problem tends to arise in an ignition coil of the type such as a PTC that is directly mounted on a plug hole of an engine due to many restrictions around the ignition coil.

Moreover, according to Japanese Laid-Open Patent Publication (Kokai) No. H11-144986, the gap between the cushioning member 62 and the secondary spool 61 cannot always be maintained uniform, and there may be a case where stress acting on insulating resin injected between the cushioning member 62 or the central core inserted into the cushioning member 62 and the secondary spool 61 supporting the pair of coils cannot be uniform, and hence the insulating resin is cracked due to distortion.

SUMMARY OF THE INVENTION

The present invention provides a high-strength ignition coil that can reduce stress produced in a coil case and prevent a casting material from being cracked when the ignition coil is mounted on an engine block.

Also, the present invention provides a high-strength ignition coil that can maintain the gap between a coil pair of a coil assembly and a core inserted in a central space of the coil assembly uniform to prevent injected and hardened insulating resin (casting material) from becoming distorted due to stress, making the insulating resin less likely to be cracked.

Accordingly, in a first aspect of the present invention, there is provided an ignition coil comprising a coil case having a mounting flange on an outer surface thereof, a coil assembly housed in the coil case, a. casting material filled into a gap between the coil case and the coil assembly and gaps of the coil assembly, and a plurality of positioning means provided on an inner wall surface of the coil case or an outer surface of the coil assembly, for positioning the outer surface of the coil assembly with respect to the inner wall surface of the coil case, wherein the inner wall surface of the coil case facing the mounting flange, or the outer surface of the coil assembly facing the mounting flange via the inner wall surface of the coil case has a limited area in which the positioning means is not provided.

According to the first aspect of the present invention, because the limited area in which there is no positioning means is provided on the inner wall surface of the coil case which faces the mounting flange provided. on the outer surface of the coil case, or the outer surface of the coil assembly, stress produced in the mounting flange when the ignition coil is fixed can be prevented from reaching an abutment surface of, for example, first guide ribs as the positioning means and the casting material, and hence cracking of the casting material can be prevented.

The first aspect of the present invention can provide an ignition coil, wherein the limited area is equal to or larger than an area of the mounting flange which occupies the outer surface of the coil case.

According to the first aspect of the present invention, because the limited area is equal to or larger than the area of the mounting flange which occupies the outer surface of the coil case, the above effect of the invention can be obtained, and in addition, cracking of the casting material due to mounting stress can be more reliably prevented.

The first aspect of the present invention can provide an ignition coil, wherein the limited area is 1.0 to 1.5 times as large as an area of the mounting flange which occupies the outer surface of the coil case.

According to the first aspect of the present invention, because the limited area is 1.0 to 1.5 times as large as the area of the mounting flange which occupies the outer surface of the coil case, the above effect of the invention can be obtained, and in addition, cracking can be prevented without bringing about a decrease in the accuracy with which the coil assembly is positioned with respect to the inner wall surface of the coil case.

The first aspect of the present invention can provide an ignition coil, wherein the positioning means is a first guide rib having a predetermined height and provided on the inner wall surface of the coil case or the outer surface of the coil assembly.

According to the first aspect of the present invention, because the positioning means is comprised of the first guide ribs having a predetermined height and provided on the inner wall surface of the coil case or the outer surface of the coil assembly, the above effect of the invention can be obtained, and in addition, the first guide ribs can be molded integrally with constructional members of the coil case or the coil assembly, and hence ease of molding can be ensured.

The first aspect of the present invention can provide an ignition coil, wherein the casting material is insulating resin.

The first aspect of the present invention can provide an ignition coil, wherein the coil assembly comprises a primary coil wound around a cylindrical primary coil bobbin, a secondary coil wound around a cylindrical secondary coil bobbin of which diameter is greater than a diameter of the primary coil bobbin and disposed concentrically with the primary coil bobbin, and a core that is fitted into a central space of the primary coil bobbin along central axes of the primary coil and the secondary coil arranged concentrically, and the positioning means is a first guide rib formed by projecting out part of an outer peripheral portion of a partition plate provided in a winding area of the secondary coil bobbin.

According to the first aspect of the present invention, the coil assembly has the primary coil wound around the cylindrical primary coil bobbin, the secondary coil wound around the cylindrical secondary coil bobbin of which diameter is greater than the diameter of the primary coil bobbin and disposed concentrically with the primary coil bobbin, and the core that is fitted into the central space of the primary coil bobbin along central axes of the primary coil and the secondary coil concentrically arranged, and the positioning means is comprised of the first guide ribs each formed by projecting out part of the outer peripheral portion of the partition plate provided in the winding area of the secondary coil bobbin. Thus, the above effect of the invention can be obtained, and in addition, the first guide ribs can be molded integrally with constructional members of the secondary coil bobbin when molding the constructional members, and the ignition coil as a whole can be reduced in size.

The first aspect of the present invention can provide an ignition coil, wherein a second guide rib for positioning a surface of the core with respect to an inner wall surface of the primary coil bobbin is provided on the surface of the core.

According to the first aspect of the present invention, because the second guide ribs are provided on the surface of the core, the above effect of the invention can be obtained, and in addition, the surface of the core can be reliably positioned with respect to the inner wall surface of the primary coil bobbin.

Accordingly, in a second aspect of the present invention, there is provided an ignition coil comprising a coil case, a coil assembly housed in the coil case, and a casting material filled into a gap between the coil case and the coil assembly and gaps of the coil assembly, wherein the coil assembly comprises a coil pair including a primary coil and a secondary coil disposed concentrically with the primary coil, and a core fitted into a central space of the coil pair to form a magnetic path, and the core has on a surface thereof second guide ribs for positioning a surface of the core with respect to an inner wall surface of a coil supporting member forming the central space of the coil pair.

According to the second aspect of the present invention, because the core has on the surface thereof the second guide ribs for positioning the surface of the core with respect to the inner wall surface of the coil supporting member forming the central space of the coil pair, the gap between the surface of the core and the inner wall surface of the coil supporting member can be made uniform. As a result, the imbalance in stress produced in injected and hardened insulating resin (casting material) can be reduced, and hence cracking can be prevented.

The second aspect of the present invention can provide an ignition coil, wherein the second guide ribs comprise a plurality of projections formed on the surface of the core which faces the inner wall surface of the coil supporting member.

According to the second aspect of the present invention, because the second guide ribs are comprised of the plurality of projections formed on the surface of the core, the above effect of the invention can be obtained, and in addition, the imbalance in stress produced in the insulating resin can be reduced, and hence cracking can be more reliably prevented.

The second aspect of the present invention can provide an ignition coil, wherein the projections are molded integrally with the core using mold resin that coats the core.

According to the second aspect of the present invention, because the projections as the second guide ribs are molded integrally with the core using mold resin that coats the core, the above effect of the invention can be obtained, and in addition, the necessity of adding a projection forming step can be eliminated, and hence the manufacturing process can be simplified.

The second aspect of the present invention can provide an ignition coil, wherein the second guide ribs are disposed at regular intervals on the surface of the core which faces the inner wall surface of the coil supporting member.

According to the second aspect of the present invention, because the second guide ribs are disposed at regular intervals on the surface of the core, the above effect of the invention can be obtained, and in addition, the imbalance in stress produced in the insulating resin can be reduced, and hence cracking can be more reliably prevented.

The second aspect of the present invention can provide an ignition coil, wherein the core is a core that comprises a center core and a side core and forms a closed magnetic path, the center core is fitted into the central space of the coil pair, and the second guide ribs are formed on a surface of the center core.

According to the second aspect of the present invention, because the center core of the core on the surface of which the second guide ribs are provided is fitted into the central space of the coil pair, the surface of the center core and the inner wall surface of the coil supporting member can be accurately positioned, so that stress produced at a boundary between the surface of the center core and insulating resin (casting material) can be reduced, and cracking can be prevented.

The second aspect of the present invention can provide an ignition coil, wherein the core is an assembly comprising a combination of a plurality of core members.

According to the second aspect of the present invention, because the core is the assembly comprised of the plurality of core members, the above effect of the invention can be obtained, and in addition, assembling the ignition coil as a whole can be made easier.

The second aspect of the present invention can provide an ignition coil, wherein the casting material is insulating resin.

The second aspect of the present invention can provide an ignition coil, wherein the coil assembly comprises a primary coil wound around a cylindrical primary coil bobbin, a secondary coil wound around a cylindrical secondary coil bobbin of which diameter is larger than a diameter of the primary coil bobbin and disposed concentrically with the primary coil bobbin, and a core that is fitted into a central space of the primary coil bobbin along central axes of the primary coil and the secondary coil arranged concentrically, and the second guide ribs for positioning the surface of the core with respect to an inner wall surface of the primary coil bobbin are provided on the surface of the core.

According to the second aspect of the present invention, the coil assembly has the primary coil wound around the cylindrical primary coil bobbin, the secondary coil wound around the cylindrical secondary coil bobbin of which diameter is larger than the diameter of the primary coil bobbin and disposed concentrically with the primary coil bobbin, and the core that is fitted into the central space of the primary coil bobbin along central axes of the primary coil and the secondary coil. concentrically arranged, and the second guide ribs for positioning the surface of the core with respect to the inner wall surface of the primary coil bobbin are provided on the surface of the core. Thus, the gap between the surface of the core and the inner wall surface of the primary coil bobbin can be maintained uniform, and hence the imbalance in stress produced in injected and hardened insulating resin can be reduced, and hence cracking can be prevented.

The features and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
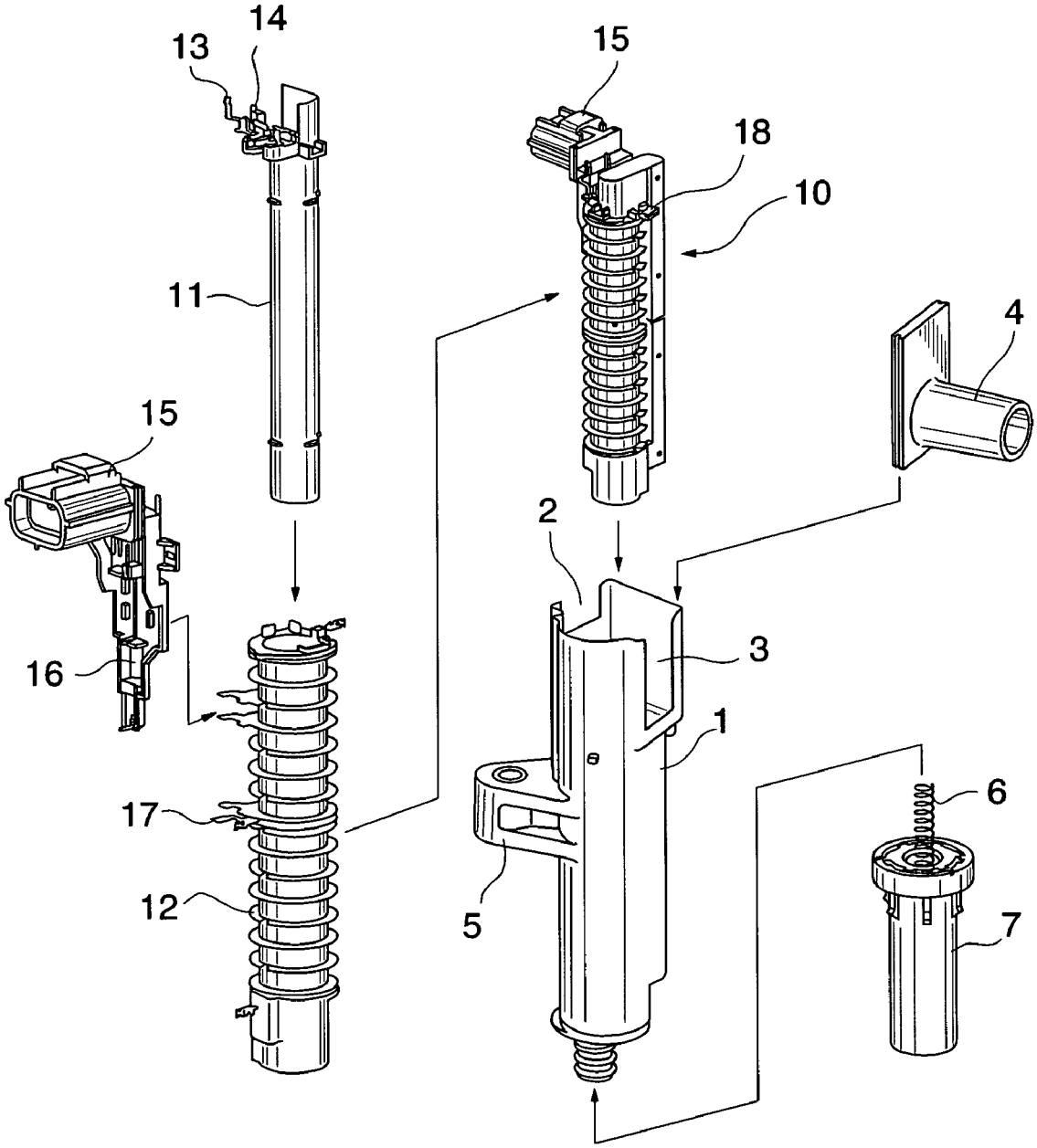
FIG. 1 is an assembly diagram showing an ignition coil for an internal combustion engine according to an embodiment of the present invention.

FIG. 1 is an assembly diagram showing an ignition coil for an internal combustion engine according to an embodiment of the present invention.

As shown in FIG. 1, the ignition coil is of a dual ignition type having two secondary output terminals, and is comprised mainly of a housing 1 as a coil case, and a coil assembly 10 fitted into the housing 1.

The coil assembly 10 is comprised of a substantially cylindrical primary coil bobbin 11 around which a primary coil (not shown) is wound, and a substantially cylindrical secondary coil bobbin 12 around which a secondary coil (not shown) is wound and of which diameter is larger than the diameter of the primary coil bobbin 11. The secondary coil bobbin 12 around which the secondary coil is wound is disposed outside and concentrically with the primary coil bobbin 11 around which the primary coil is wound. The primary coil and the secondary coil thus form a concentrically-arranged coil pair.

Primary terminals 13 and 14 are forcibly pressed into one end of the primary coil bobbin 11, and the start of winding and the end of winding of the primary coil are connected to the primary terminals 13 and 14, respectively, by fusing or the like. The primary terminals 13 and 14 are inserted into a connector 15 from one end thereof, and the connector 15 is fixed at a predetermined location of the secondary coil bobbin 12.

A center core portion of a core 18 forming a magnetic path is fitted into a central space of the primary coil bobbin 11 along the central axis of the coil pair including the primary coil and secondary coil that are concentrically arranged, and as a result, the coil assembly 10 comprised mainly of the primary coil, the secondary coil, and the core 18 is constructed.

Figure 2:
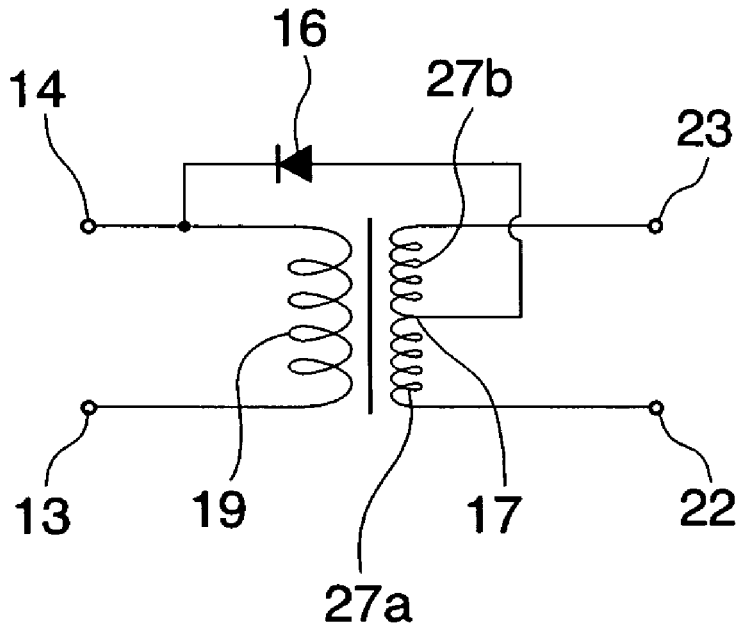
FIG. 2 is a connection wiring diagram of the coil assembly appearing in FIG. 1.

FIG. 2 is a connection wiring diagram of the coil assembly appearing in FIG. 1.

As shown in FIG. 2, the primary terminal 13 as the start of winding of the primary coil 19 is connected to a control circuit (not shown), which controls the conduction of the primary coil, via the connector 15 (see FIG. 1). A cathode of a diode 16 (see FIG. 1) fixed to the connector 15 is connected to the primary terminal 14 as the end of winding of the primary coil and also connected to the positive (+) side of a battery (not shown) via the connector 15. An anode of the diode 16 is, for example, L-shaped, and is connected at the L-shaped portion to a midtap 17 as the midpoint of the secondary coil wound around the secondary coil bobbin 12. Outer ends of the respective secondary coils 27*a* and 27*b* wound around the secondary coil-bobbin 12 are connected to secondary output terminals 22 and 23, respectively.

As shown in FIG. 1, a cut portion 2 with which the above described connector 15 is to be engaged is provided in an opening end of an upper portion of the housing 1 as a coil case. A cut portion 3 with which an H/T tower 4 as a take-out end for secondary output is to be engaged is provided such as to face the housing 1 across the central axis of the housing 1. Moreover, a mounting flange 5 for fixing the ignition coil to an engine block is provided on an outer surface of the housing 1.

In the coil assembly 10 and the housing 1 constructed as described above, the coil assembly 10 is fitted into the housing 1 having the cut portion 3 with which the H/T tower 4 is engaged so as to engage the connector 15 with the cut portion 2, one of the secondary output terminals is joined to the H/T tower 4, a plug cap 7 having a spring 6 therein is engaged with one end (lower end as viewed in FIG. 1) of the housing 1 as a connector for the other one of the secondary output terminals, and insulating resin is filled into gaps between the constructional members, so that the ignition coil is constructed. A plurality of first guide ribs are provided on an outer peripheral portion of the secondary coil bobbin 12 as the constructional member of the coil assembly 10 so that the coil assembly 10 can be positioned with respect to an inner wall surface of the housing 1.

Figure 3:
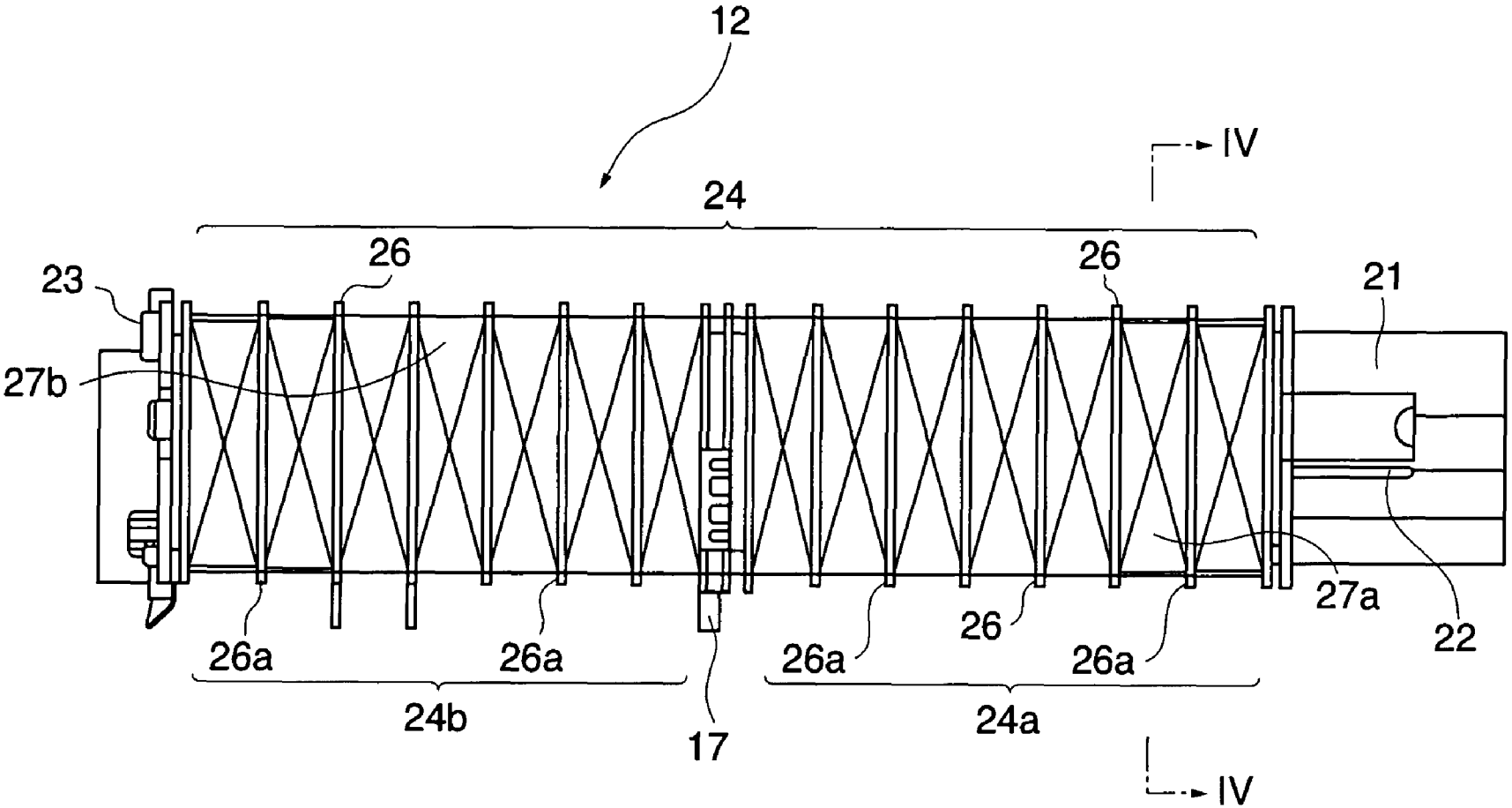
FIG. 3 is a plan view showing a secondary coil bobbin that is a constructional member of the coil assembly.

FIG. 3 is a plan view showing the secondary coil bobbin that is the constructional member of the coil assembly.

As shown n FIG. 3, the secondary coil bobbin 12 is comprised mainly of a cylindrical secondary coil bobbin main body 21 made of modified PPO (polyphenylene oxide) resin, and the first secondary output terminal 22 and the second secondary output terminal 23 provided at respective ends of the secondary coil bobbin main body 21 in the longitudinal direction thereof.

An outer surface of the secondary coil bobbin main body 21 is a winding area 24 around which coils are wound. The above described midtap 17 is provided in substantially the center of the winding area 24 and divides the winding area 24 into a first winding area 24*a* and a second winding area 24*b*. Each of the winding areas 24*a* and 24*b* is partitioned at regular intervals by a plurality of partition plates 26 extended in the direction of the normal to an outer peripheral surface of the secondary coil bobbin main body 21.

Coils are wound in opposite directions (reversely wound) around the first winding area 24*a* and the second winding area 24*b* of the winding area 24 divided by the midtap 17, so that the secondary coils 27*a* and 27*b* wound in opposite directions are formed.

Ends of the secondary coils 27*a* and 27*b* on the coil bobbin longitudinal direction midsection side are connected to the midpoint of the midtap 17. On the other hand, the other end of the first secondary coil 27*a* is connected to the first secondary output terminal 22, and the other end of the second secondary coil 27*b* is connected to the second secondary output terminal 23. The two secondary output terminals 22 and 23 are connected to secondary high-voltage terminals (terminals connected to the H/T tower 4, the plug cap 7, and so on) by fitting the coil assembly 10 into the housing, whereby high-voltage output is taken out.

Arbitrary ones (four ones in FIG. 3) of the plurality of partition plates 26 that partition the winding areas 24*a* and 24*b* at regular intervals, for example, the second partition plates and the outermost partition plates as viewed from the midtap 17 in the first winding area 24*a* and the second winding area 24*b* are constructed as ribbed partition plates 26*a* that have on outer peripheral portions thereof projections that should be first guide ribs 28 for positioning.

Figure 4:
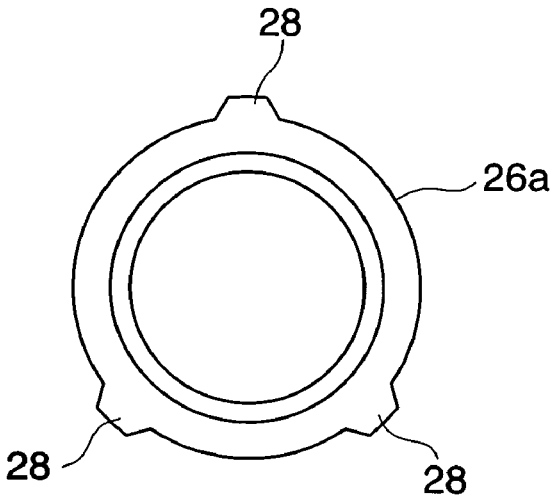
FIG. 4 is a sectional view taken along line IV-IV of FIG. 3.

FIG. 4 is a sectional view taken along line IV-IV of FIG. 3. As shown in FIG. 4, a plurality of, i.e. three in FIG. 4, first guide ribs 28 are provided on the outer peripheral portion of the ribbed partition plate 26*a*. The intervals at which the first guide ribs 28 are disposed on one ribbed partition plate 26*a* should not necessarily be equal, but the first guide ribs 28 and the ribbed partition plate 26*a* are preferably disposed or provided such that the first guide ribs 28 are disposed at regular intervals on the outer surface of the secondary coil bobbin 12. As a result, the gap between the secondary coil bobbin 12, and by extension the coil assembly 10 and the inner wall surface of the housing 1 can be maintained uniform, and the coil assembly 10 can be accurately positioned with respect to the inner wall surface of the housing 1.

The first guide rib 28 projects out from the outer peripheral portion of the ribbed partition plate 26*a* by, for example, 1 mm to 1.5 mm. Thus, the coil assembly 10 can be accurately positioned, and adequate strength of the partition plate 26*a* can be ensured.

In the present embodiment, a limited area in which no first guide rib 28 is provided is formed on an outer surface of the coil assembly 10 which faces the mounting flange 5 on the outer surface of the housing 1 across the wall of the housing 1.

When the ignition coil is to be fixed on the engine block (not shown) by the mounting flange 5, mounting stress acts on boundaries between the first guide ribs 28 and a casting material, and as a result, the casting material may be cracked. In the present embodiment, to prevent such cracking, the limited area in which no first guide rib 28 is provided is formed on the outer surface of the coil assembly 10 which faces the mounting flange 5 on the outer surface of the housing 1 across the wall of the housing 1.

Figure 5:
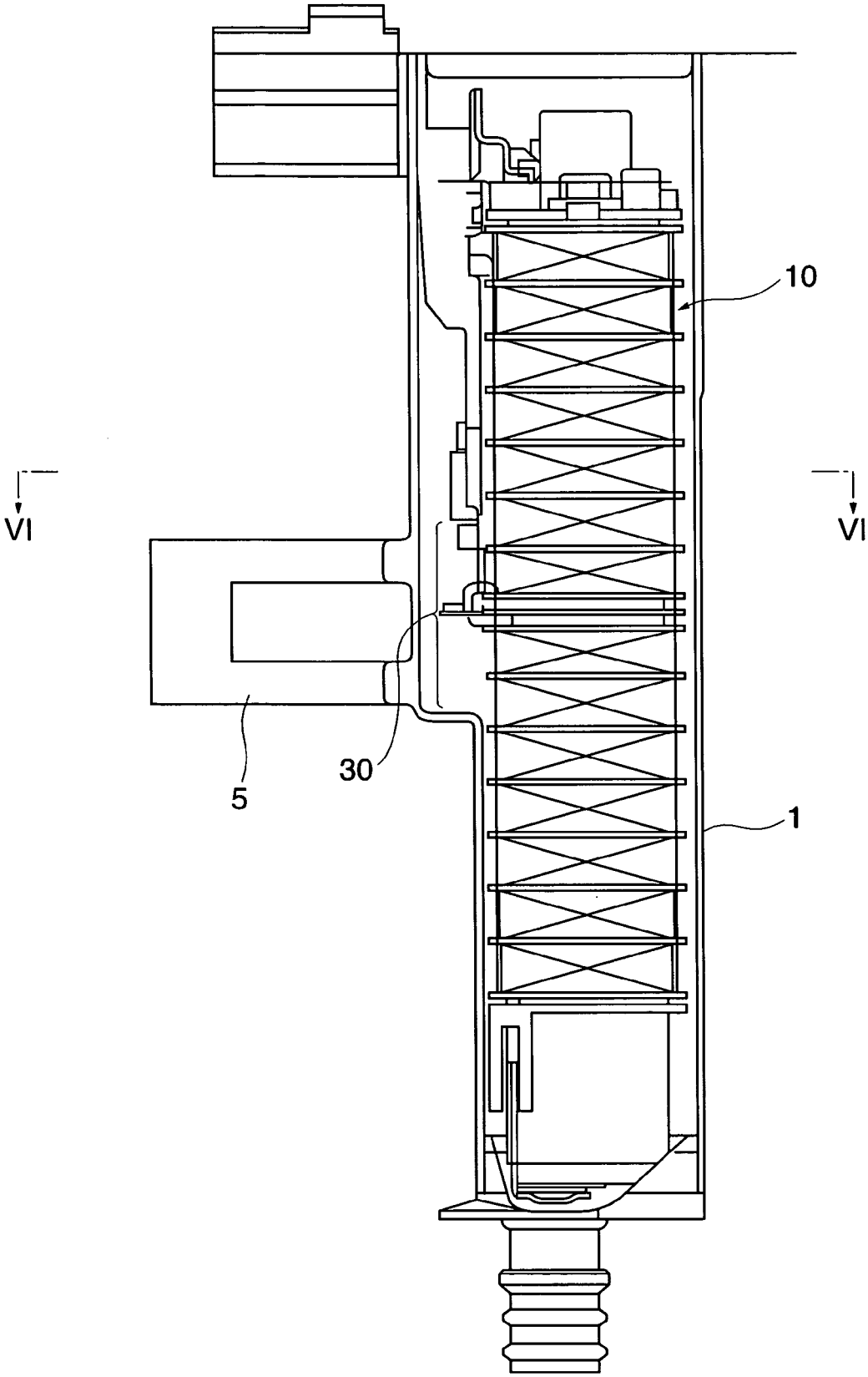
FIG. 5 is a longitudinal sectional view showing the ignition coil with a coil assembly inserted into a housing.
Figure 6:
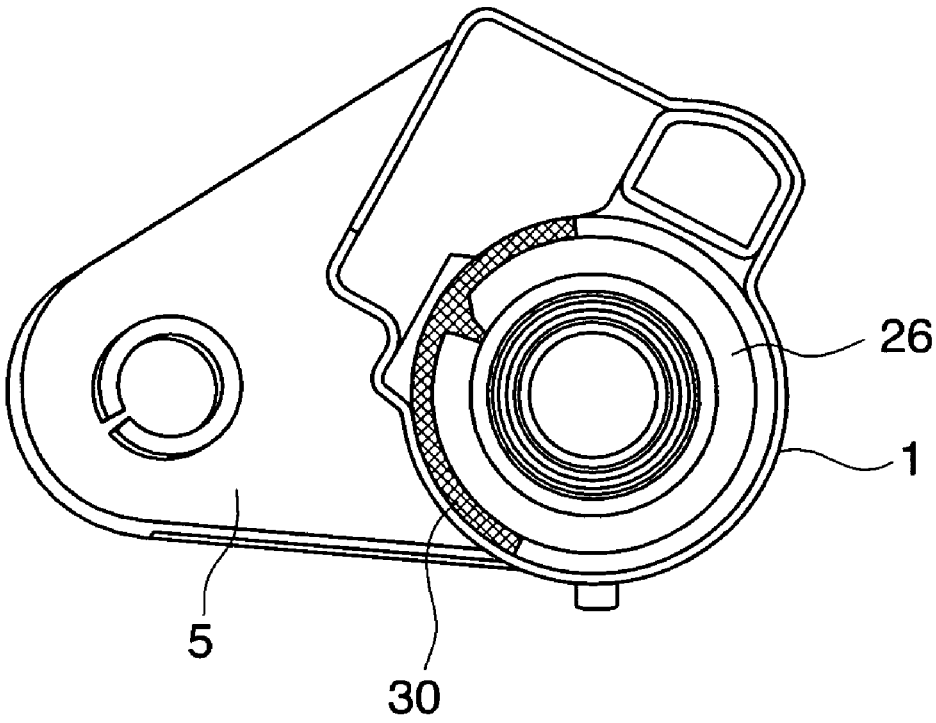
FIG. 6 is a sectional view taken along line VI-VI of FIG. 5.

FIG. 5 is a longitudinal sectional view showing the ignition coil of which coil assembly 10 is inserted into the housing 1, and FIG. 6 is a sectional view taken along line VI-VI of FIG. 5.

As shown in FIG. 5, the coil assembly 10 is fitted into the housing 1. The mounting flange 5 is provided on the outer surface of the housing 1, and the limited area 30 in which no first guide rib 28 is provided is formed on the coil assembly 10, specifically the partition plates 26 on the surface of the secondary coil bobbin 12, which faces the mounting flange 5 across the wall of the housing 1.

Figure 7:
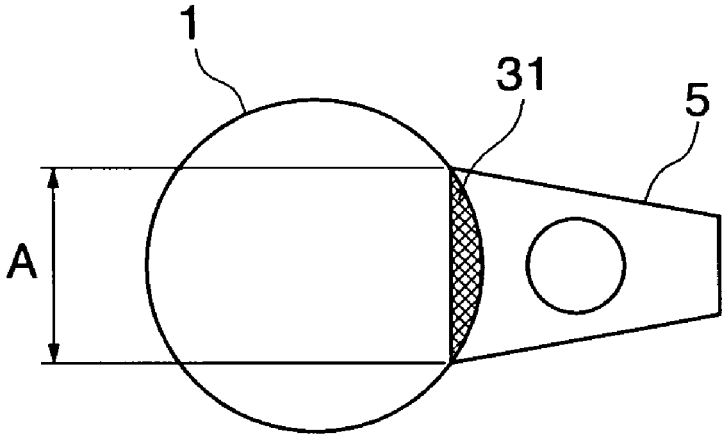
FIG. 7 is a horizontal sectional view useful in explaining a limited area and schematically showing a mounting flange portion of the housing.
Figure 8:
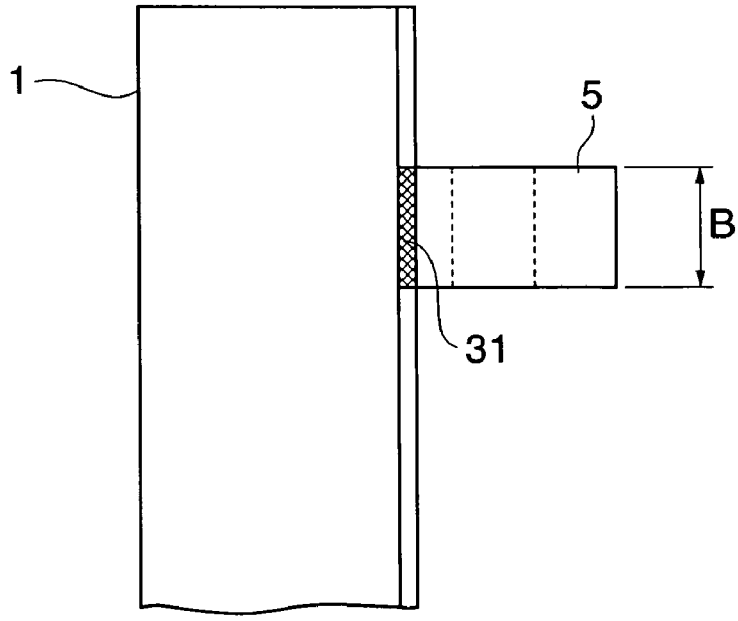
FIG. 8 is a vertical sectional view useful in explaining the limited area and schematically showing the mounting flange portion of the housing.
Figure 9:
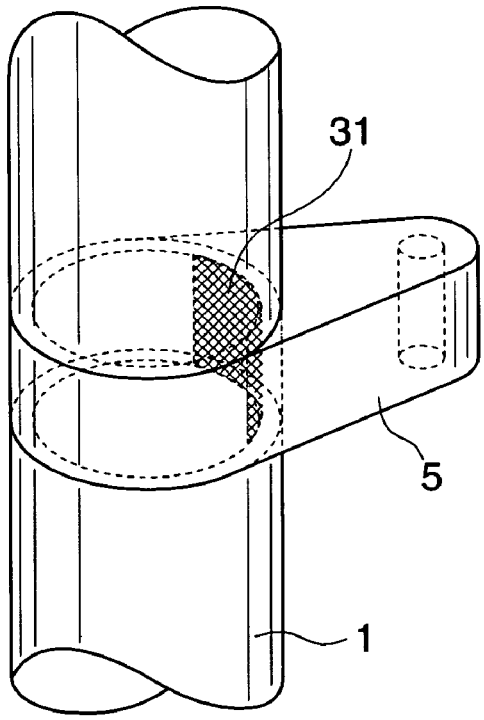
FIG. 9 is a conceptual perspective view useful in explaining the limited area and schematically showing the mounting flange portion of the housing.

FIGS. 7 to 9 are views useful in explaining the limited area in which no first guide rib is provided, in which FIG. 7 is a horizontal sectional view schematically showing the mounting flange 5 of the housing 1 and its vicinity, FIG. 8 is a vertical sectional view schematically showing the mounting flange 5 of the housing 1 and its vicinity, and FIG. 9 is a conceptual perspective view schematically showing the mounting flange 5 of the housing 1 and its vicinity.

As shown in FIGS. 7 to 9, the limited area is a surface portion (denoted by reference numeral 30 in FIGS. 5 and 6) of the secondary coil bobbin 12 which faces an area 31 defined by the maximum width A of the mounting flange 5 on the horizontal sectional view of FIG. 7 and the maximum thickness B of the mounting flange 5 on the vertical sectional view of FIG. 8. Because there is the limited area 30 in which no first guide rib 28 is provided, the casting material can be prevented from being cracked due to stress acting on joint surfaces of the first guide ribs 28 and the casting material when the ignition coil is mounted on the engine block.

In the present embodiment, the limited area 30 in which no first guide rib 28 is provided is formed on the surface of the secondary coil bobbin 12 which corresponds to the mounting flange 5 across the housing 1, and includes the area defined by the maximum width A and the maximum thickness B of the mounting flange 5 which occupies the outer surface of the housing 1 and is equal to or larger than the area. If there is no first guide rib 28 within at least a surface corresponding to the surface defined by at least the maximum width A and the maximum thickness B of the mounting flange 5, the casting material can be prevented from being cracked due to the presence of the first guide ribs 28 for positioning the coil assembly 10 with respect to the housing 1.

In the present embodiment, the ignition coil has the first guide ribs 28 provided on the surface of the coil assembly 10, in other words, the surface of the secondary coil bobbin 12, but in the present embodiment, the first guide ribs may be provided on not only the outer surface of the coil assembly 10 but also the inner wall surface of the housing 1. In this case, similarly to the above described embodiment, for example, by molding the first guide ribs integrally with the housing 1 such that the first guide ribs are disposed at regular intervals on the inner wall surface of the housing 1, the coil assembly 10 is positioned with respect to the inner wall surface of the housing 1. Moreover, similarly to the above described embodiment, a limited area 30 in which there is no first guide rib and which is equal to or larger than the area occupied by the mounting flange 5 on the outer surface of the housing 1 is provided on the inner wall surface of the housing 1 which faces the surface defined by the maximum width A and the maximum thickness B of the mounting flange 5 across the housing 1. In this case as well, the same effects as those in the above described embodiment can be obtained.

Figure 10:
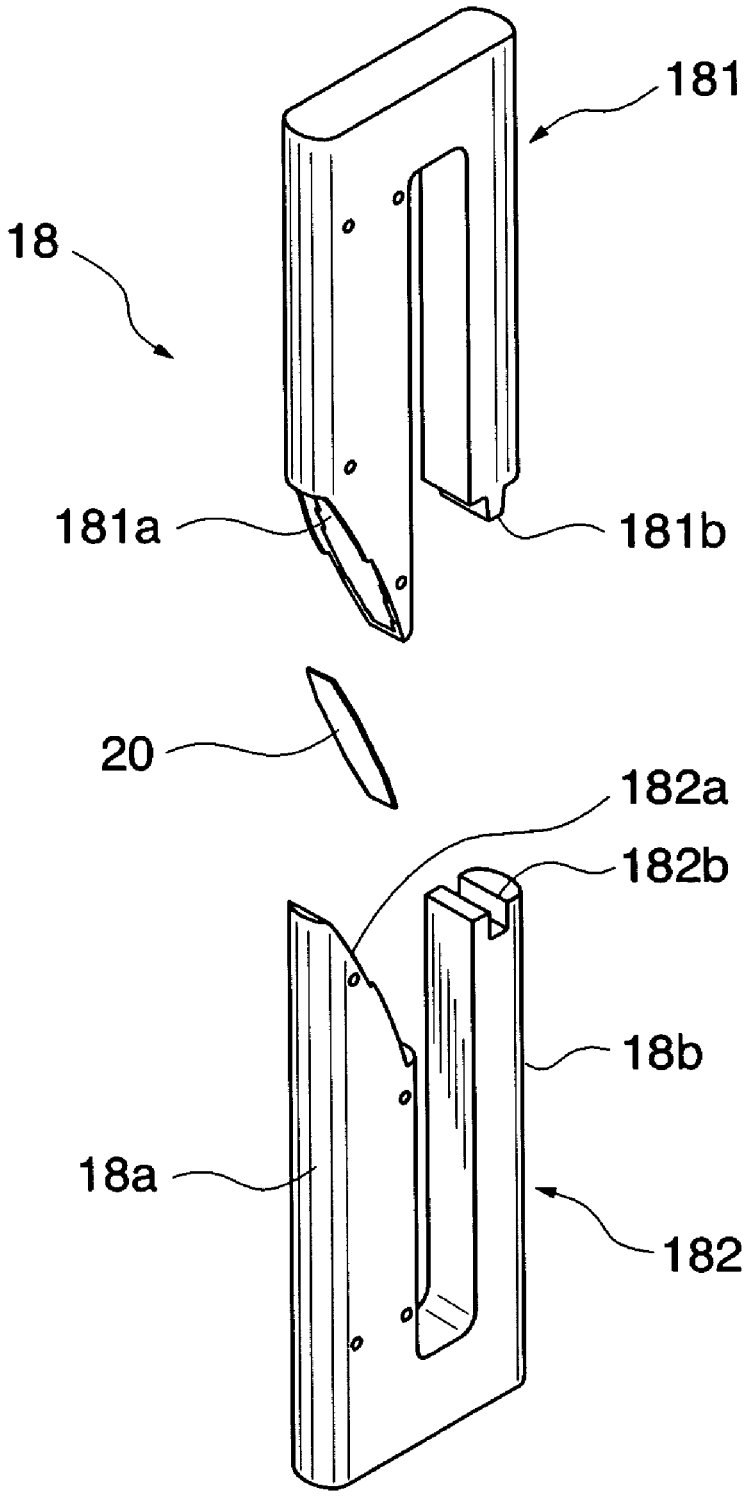
FIG. 10 is a perspective view showing a core as a constructional member of the coil assembly.

FIG. 10 is a perspective view showing the core 18 as the constructional element of the coil assembly 10.

As shown in FIG. 10, the core 18 is comprised of two core members 181 and 182 that are substantially square U-shaped. By combining the core members 181 and 182 together, for example, a closed magnetic path that is rectangular in frontal view is formed.

One joint portion of the core members 181 and 182 is an inclined joint portion that is inclined at a predetermined angle such as 10 to 20 degrees to the joining direction, i.e. the vertical direction as viewed in FIG. 10. That is, the core members 181 and 182 have inclined joint surfaces 181*a* and 182*a*, respectively. A plate-shaped permanent magnet 20 is interposed between the inclined joint surfaces 181*a* and 182*a*. Thus, a magnetic flux passing through the core 18 is reverse-biased, resulting in increased output.

Joint portions other than the above-mentioned one joint portion are joint surfaces formed by engagement of concave and convex surfaces. The core member 181 has, for example, a convex joint surface 181*b*, and the core member 182 has, for example, a concave joint surface 182*b*.

Portions of the core members 181 and 182 other than the above-mentioned joint surfaces, more specifically, the surfaces of the core members 181 and 182 other than the above-mentioned joint surfaces and the flat surface of an upper end of the core member 181 are coated with mold resin. Insulating epoxy resin, for example, is used as the mold resin.

The mold resin around the inclined joint surfaces 181*a* and 182*a* of the core members 181 and 182 partially projects out from the inclined joint surfaces 181*a* and 182*a* by a predetermined height, that is, a height corresponding to the thickness of the magnet 20, for example, about 0.5 mm to 2.0 mm. When the core members 181 and 182 are combined together, the projecting mold resin coating covers the total circumferences of the inclined joint surfaces 181*a* and 182*a*, and a housing space for the magnet 20 which is enclosed by the inclined joint surfaces 181*a* and 182*a* and the projecting mold resin coating is formed.

Because the plate-shaped magnet 20 is confined in the closed space enclosed by the mold resin, the casting material does not directly contact the plate-shaped magnet 20 when the coil assembly 10 having the core 18 forming the magnetic path is inserted into the housing 1 and the casting material is filled into the gaps between the constructional members and then thermally-hardened to complete the ignition coil. Thus, stress can be prevented from being produced around the plate-shaped magnet 20 due to the interposition of the plate-shaped magnet 20 between the joint surfaces, and hence adequate strength of the ignition coil can be ensured.

Figure 11:
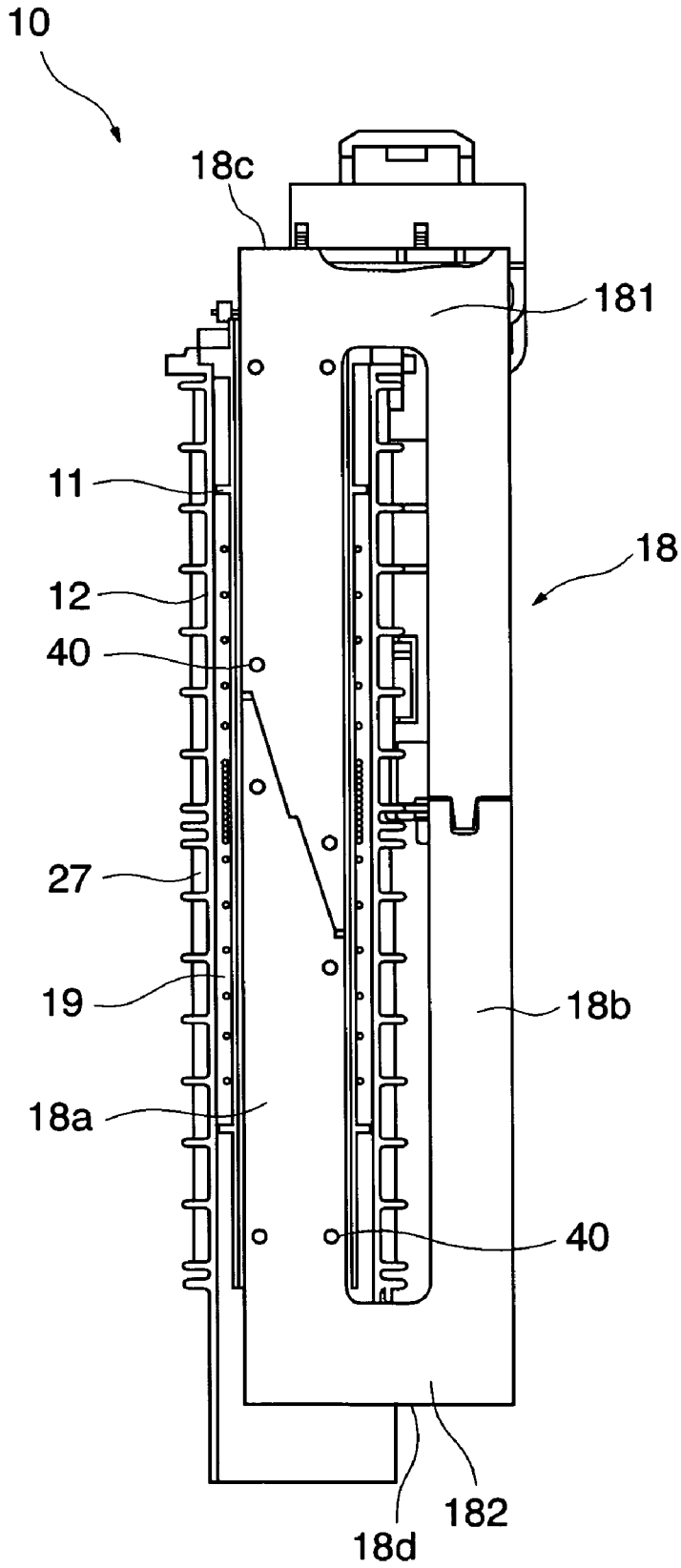
FIG. 11 is a view useful in explaining the coil assembly of which core is inserted into a central space of a coil pair.
Figure 12:
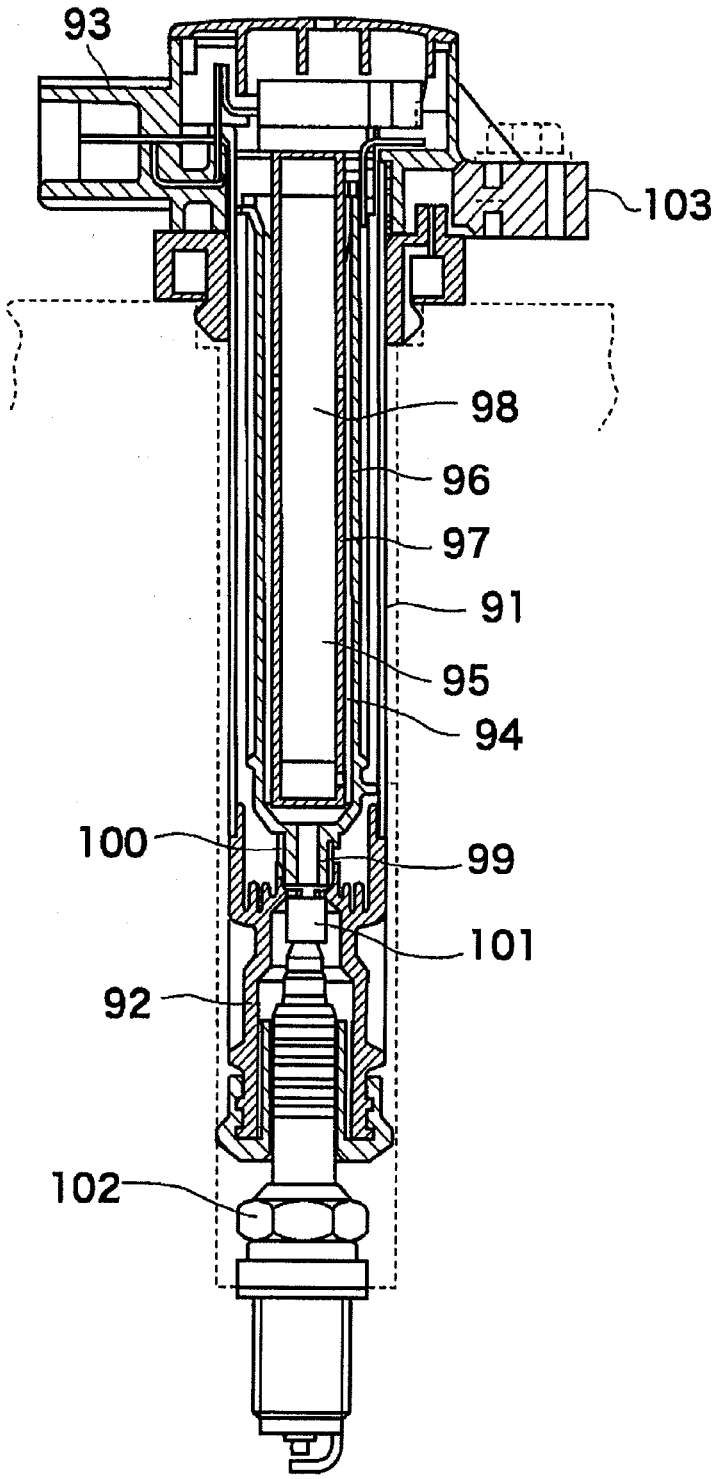
FIG. 12 PRIOR ART
FIG. 12 is a longitudinal sectional view showing a conventional ignition coil.
Figure 13:
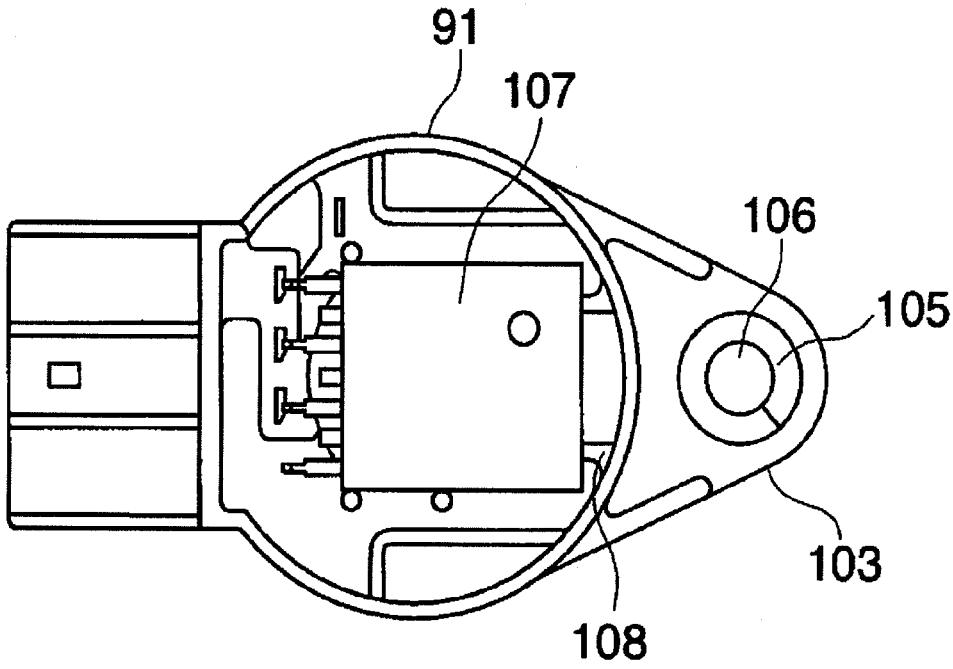
PRIOR ART FIG. 13
FIG. 13 is a horizontal sectional view showing a mounting flange appearing in FIG. 12 and its vicinity.
Figure 14:
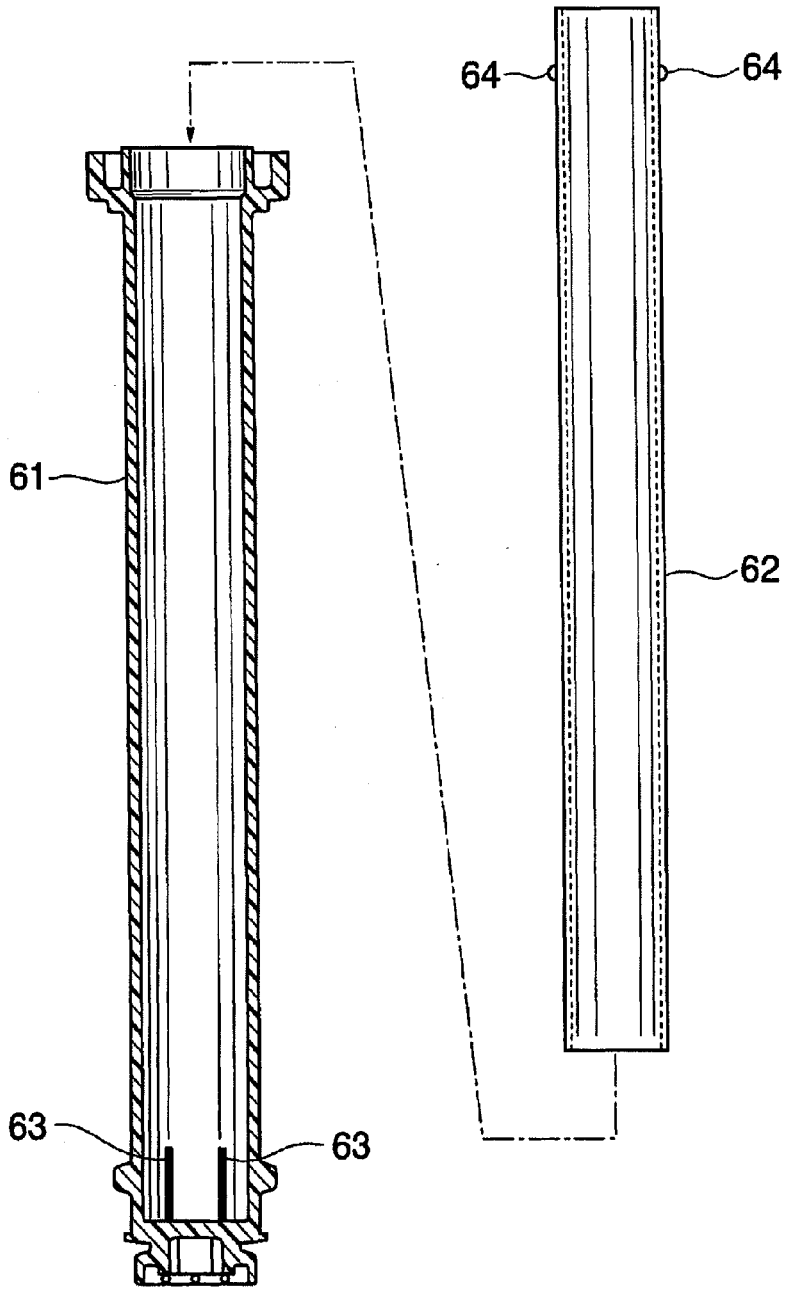
FIG. 14 PRIOR ART
FIG. 14 is a longitudinal sectional view showing the relationship between a secondary spool and a cushioning member disposed around a central core in a conventional ignition coil.

FIG. 11 is a view useful in explaining the coil assembly in which the core 18 is fitted into a central space of the coil pair. It should be noted that in FIG. 11, the coil pair is illustrated in a sectional view, but the core 18 is illustrated in a frontal view for the convenience of explanation.

As shown in FIG. 11, the primary coil 19 is wound around the primary coil bobbin 11, and the secondary coil 27 is wound around the secondary coil bobbin 12. The diameter of the secondary coil bobbin 12 is larger than that of the primary coil bobbin 11, and the secondary coil bobbin 12 is disposed outside and concentrically with the primary coil bobbin 11. The primary coil 19 and the secondary coil 27 form the pair of coils that are concentrically arranged.

The core 18 is an assembly comprised of a combination of the core members 181 and 182. The core 18 that forms the closed magnetic path is formed by interposing the magnet 20 between the inclined joint surface 181*a* of the core member 181 and the inclined joint surface 182*a* of the core member 182 and joining the convex joint surface 181*b* of the core member 181 and the concave joint surface 182*b* of the core member 182 together (see FIG. 10).

A center core 18*a* that is part of the core 18 is fitted into the central space of the coil pair, that is, the central space of the primary coil bobbin 11 as the coil supporting member for the coil pair, and a side core 18*b* parallel to the center core 18*a* is disposed along the outer surface of the secondary coil bobbin 12 as the constructional member of the coil pair. Because the core 18 is constructed as an assembly of the core members 181 and 182, assembly in fitting part of the core 18 into the central space of the coil assembly 10 is easy.

Projections 40 as second guide ribs for positioning the surface of the center core 18*a* with respect to the inner wall surface of the primary coil bobbin 11 are provided on a surface of the center core 18*a* of the core 18. The projections 40 have the same height and project out from the surface of the center core 18*a* by, for example, 0.05 mm to 0.6 mm. The distal ends of the respective projections 40 abut on an inner wall surface of the primary coil bobbin 11. Thus, the gap between the inner wall surface of the primary coil bobbin 11 and the surface of the center core 18*a* can be made uniform, and the surface of the center core 18*a* can be accurately positioned with respect to the inner wall surface of the primary coil bobbin 11. Further, stress produced in the casting material of the ignition coil can be made uniform, and cracking can be prevented. It is preferred that the projections 40 are disposed at regular intervals, for example, in the longitudinal direction and the outer circumferential direction of the center core 18*a*.

The core members 181 and 182 are usually coated with mold resin, and the projections 40 as the second guide ribs can be molded at the same time in the resin molding step.

In the ignition coil according to the present embodiment, it is preferred that pin marks, which are formed on mold resin coating when the core members 181 and 182 constructing the core 18 are coated with mold resin, are further filled with insulating resin so as to reduce projections and depressions on the surface.

When the core members are insert-molded, that is, when the core members are coated with mold resin, marks of holding pins that hold the core members in molds are left as concave portions on the surface of the mold resin, and insulating resin as a hardened casting material of the ignition coil may be cracked due to the concave portions. To solve this problem, in the present embodiment, once the core members have been coated with the mold resin, for example, the second molding is carried out so as to eliminate the pin marks formed during the coating, so that the concave portions on the surface of the mold resin are filled with insulating resin, and hence cracking can be prevented.

In the ignition coil according to the present embodiment, one end of the core 18 that forms the close magnetic path is coated with an elastic member.

One end of the core 18, for example, an end of the core 18 that is located at an opening end of an upper portion of the housing 1 when the coil assembly 10 is fitted into the housing 1 has a magnetic material exposed portion because of insert molding. If, for example, a directional silicon steel sheet is used for the magnetic material exposed portion of the core 18, and a casting material is injected, the casting material strongly presses down a C-end 18*c* (see FIG. 11) of the directional silicon steel sheet after the casting material is hardened, and hence predetermined secondary output cannot be obtained due to the effect of magnetostriction which is not negligible. Thus, in the present embodiment, a D-end 18*d* (see FIG. 11) of the core 18 is coated with insulating resin by insert molding, and the above described magnetic material exposed end (C-end) 18*c* of the core 18 is coated with an elastic member.

In this case, it is preferred that, for example, mold resin that coats the end face of the core 18 is raised by a predetermined height, for example, 1 to 2 from the magnetic material exposed end face so as to form a peripheral wall surrounding the magnetic material exposed end face so that the end face of the core 18 can be the bottom surface of the concave portion surrounded by the mold resin. The elastic member is then disposed in the concave portion and thermally caulked by the mold resin.

A foamed sponge made of silicon rubber is suitably used as the elastic member. In this case, it is preferred that the foamed sponge as the elastic member is provided with through holes penetrating therethrough in the direction of thickness. This enables a void and a casting material to be smoothly passed through the foamed sponge during injection of the casting material.

In the present embodiment, it is preferred that in the coil assembly, the central point of the primary coil in the direction of winding width (the longitudinal direction of the primary coil bobbin 11) is shifted by a predetermined width toward the secondary coil 27*b* having the secondary output terminal 23 connected to one ignition plug via a high-tension chord and the H/T tower 4 from the central point of the secondary coil, which faces the primary coil, in the direction of winding width (the longitudinal direction of the secondary coil bobbin 12).

The ignition coil according to the present embodiment is a dual ignition type coil comprised of the two secondary output terminals (22 and 23) as described above and is applied to an engine having two ignition plugs in one cylinder. One (22) of the secondary output terminals is connected to one of the ignition plugs, and the other one (23) of the secondary output terminals is connected to the other one of the ignition plugs via the high-tension chord. Here, the floating capacitance at the secondary output terminal 23 connected to the ignition plug via the high-tension chord is greater than the floating capacitance at the secondary output terminal 22 directly connected to the ignition plug.

In general, an output voltage from an output terminal with high floating capacitance is lower than an output voltage from an output terminal with low floating capacitance. To solve this problem, in the present embodiment, the central point of the primary coil in the direction of winding width is shifted from the central point of the secondary coil in the direction of winding width toward the secondary coil 27*b* having the secondary output terminal 23 with high floating capacitance by a predetermined width, for example, 1.5 to 3.0 whereby the binding coefficient K of the primary coil and the secondary coil at the secondary output terminal 23 with high floating capacitance is increased to compensate for a decrease in secondary output resulting from an increase in floating capacitance, and voltages output from the two secondary output terminals 22 and 23 are balanced.

The above described coil assembly 10 that has the primary coil and the secondary coil and in which the center core 18*a* of the core 18 that forms the closed magnetic path is fitted into the central space of the coil pair comprised of the primary coil and the secondary coil that are concentrically arranged is fitted into the housing 1 having the mounting flange 5 on the outer surface thereof, and with the coil assembly 10 being positioned in the housing 1, insulating resin is filled into gaps between the constructional members, so that the ignition coil according to the present embodiment is formed.

The ignition coil constructed as described above is fixed at a predetermined location of the engine block, and one secondary output terminal 22 is mounted on a plug hole of an engine and directly connected to one ignition plug engaged with the plug cap 7 mounted on, for example, a lower end of the housing 1. The other secondary output terminal 23 is connected to the other ignition plug disposed in the same cylinder via the high-tension chord. Each of the secondary output terminals 22 and 23 outputs a secondary output voltage to act as an engine ignition source.

According to the present embodiment, the limited area 30 that is equal to or larger than the area defined by the maximum width A and the maximum thickness B of the mounting flange 5 and in which no first guide rib is provided is formed on the surface of the housing 1 which faces the coil assembly 10, i.e. the inner wall surface of the coil case which faces the mounting flange 5. As a result, when the ignition coil is fixed to the engine block, a crack in the casting material originating on the constructional members due to stress can be prevented from being produced.

Moreover, according to the present embodiment, because the plurality of projections 40 (second guide ribs) that have the same height and position the surface of the center core 18*a* with respect to the inner wall surface of the primary coil bobbin 11 are disposed on the surface of the center core 18*a* of the core 18, the surface of the center core 18*a* can be accurately positioned with respect to the inner wall surface of the primary coil bobbin 11. As a result, the thickness of insulating resin injected between the inner all surface of the primary coil bobbin 11 and the surface of the center core 18*a* can be made uniform, and hence distortion of stress acting on the insulating resin can be eliminated to prevent cracking.

In the present embodiment, the limited area 30 in which no first guide rib is provided is equal to or larger than the area of the mounting flange 5 which occupies the outer surface of the housing 1, but it is preferred that the limited area 30 is 1.0 to 1.5 times as large as the area of the mounting flange 5 which occupies the outer surface of the housing 1. If the limited area 30 is too small, the effect of preventing cracking decreases, and on the other hand, if the limited area 30 is too large, this will adversely affect the coil assembly positioning effect.

It should be noted that in the present embodiment, the limited area 30 in which there is no first guide rib 28 for positioning is part of the total area in which the outer surface of the coil assembly 10 and the inner wall surface of the housing 1 face each other, and hence the limited area 30 hardly affects the effect of positioning the coil assembly 10 with respect to the inner wall surface of the housing 1. Thus, the gap between the inner wall surface of the housing 1 and the coil assembly 1 can be maintained uniform, and hence the effect obtained by providing the guide ribs 28, that is, the effect of enabling stress to act uniformly on an insulating casting material and effectively preventing cracking can be exerted to a satisfactory extent.

In the present embodiment, it is preferred that, when the core members 181 and 182 are coated with mold resin, the projections 40 as the second guide ribs provided on the center core 18*a* are molded integrally with the mold resin coating. This improves moldability and eliminates the need to add a projection molding step.

Although in the present embodiment, the ignition coil is of the dual ignition type having two secondary output terminals, the present invention is not limited to this, but the present invention may be applied to ignition coils having only one secondary output terminal, and other types of ignition coils.

What is claimed is:

1. An ignition coil comprising:

a coil case having a mounting flange on an outer surface thereof;

a coil assembly housed in said coil case;

a casting material filled into a gap between said coil case and said coil assembly and gaps of said coil assembly; and a plurality of positioning means provided on one of an inner wall surface of said coil case and an outer surface of said coil assembly, for positioning the outer surface of said coil assembly with respect to the inner wall surface of said coil case, wherein said plurality of positioning means are nonpresent in a limited area including the inner wall surface of said coil case facing the mounting flange, and the outer surface of said coil assembly facing the mounting flange via the inner wall surface of said coil case.

2. The ignition coil as claimed in claim 1, wherein the limited area is equal to or larger than an area of the mounting flange which occupies the outer surface of said coil case.

3. The ignition coil as claimed in claim 1, wherein the limited area is 1.0 to 1.5 times as large as an area of the mounting flange which occupies the outer surface of said coil case.

4. The ignition coil as claimed in claim 1, wherein said positioning means is a first guide rib having a predetermined height and provided on the inner wall surface of said coil case or the outer surface of said coil assembly.

5. The ignition coil as claimed in claim 1, wherein said casting material is insulating resin.

6. The ignition coil as claimed in claim 1, wherein said coil assembly comprises a primary coil wound around a cylindrical primary coil bobbin, a secondary coil wound around a cylindrical secondary coil bobbin of which diameter is greater than a diameter of the primary coil bobbin and disposed concentrically with the primary coil bobbin, and a core that is fitted into a central space of the primary coil bobbin along central axes of the primary coil and the secondary coil arranged concentrically, and said positioning means is a first guide rib formed by projecting out part of an outer peripheral portion of a partition plate provided in a winding area of the secondary coil bobbin.

7. The ignition coil as claimed in claim 6, wherein a second guide rib for positioning a surface of said core with respect to an inner wall surface of the primary coil bobbin is provided on the surface of the core.

8. An ignition coil comprising:

a coil case;

a coil assembly housed in said coil case; and a casting material filled into a gap between said coil case and said coil assembly and gaps of said coil assembly, wherein said coil assembly comprises a coil pair including a primary coil and a secondary coil disposed concentrically with said primary coil, and a core fitted into a central space of said coil pair to form a magnetic path, and wherein said core has on a surface thereof second guide ribs for positioning a surface of said core with respect to an inner wall surface of a coil supporting member forming the central space of said coil pair to thereby form a gap between the inner wall surface of said coil supporting member and said core.

9. The ignition coil as claimed in claim 8, wherein said second guide ribs comprise a plurality of projections formed on the surface of said core which faces the inner wall surface of the coil supporting member.

10. The ignition coil as claimed in claim 9, wherein said projections are molded integrally with said core using mold resin that coats said core.

11. The ignition coil as claimed in claim 8, wherein said second guide ribs are disposed at regular intervals on the surface of said core which faces the inner wall surface of the coil supporting member.

12. The ignition coil as claimed in claim 8, wherein said core is a core that comprises a center core and a side core and forms a closed magnetic path, said center core is fitted into the central space of said coil pair, and said second guide ribs are formed on a surface of said center core.

13. The ignition coil as claimed in claim 8, wherein said core is an assembly comprising a combination of a plurality of core members.

14. The ignition coil as claimed in claim 8, wherein said casting material is insulating resin.

15. The ignition coil as claimed in claim 8, wherein said coil assembly comprises a primary coil wound around a cylindrical primary coil bobbin, a secondary coil wound around a cylindrical secondary coil bobbin of which diameter is larger than a diameter of the primary coil bobbin and disposed concentrically with the primary coil bobbin, and a core that is fitted into a central space of the primary coil bobbin along central axes of the primary coil and the secondary coil arranged concentrically, and said second guide ribs for positioning the surface of said core with respect to an inner wall surface of the primary coil bobbin are provided on the surface of said core.

* * * * *